United States Patent [19]

Zloch et al.

[11] Patent Number: 4,780,055

[45] Date of Patent: Oct. 25, 1988

[54] AXIAL TORQUE GOVERNOR FOR A TURBO-SUPERCHARGER FOR INTERNAL COMBUSTION ENGINES

[75] Inventors: Norbert Zloch, Darmstadt; Christiane Roemuss, Beindersheim, both of Fed. Rep. of Germany

[73] Assignee: Aktiengesellschaft Kühnle, Kopp & Kausch, Fed. Rep. of Germany

[21] Appl. No.: 41,844

[22] Filed: Apr. 23, 1987

[30] Foreign Application Priority Data

Apr. 24, 1986 [DE] Fed. Rep. of Germany ..... 3613857

[51] Int. Cl.[4] ..... F02B 37/00; F04D 29/46

[52] U.S. Cl. ..... 415/160; 415/185

[58] Field of Search ..... 415/149 R, 150, 151, 415/159, 160, 185, 191; 60/600, 601, 611

[56] References Cited

U.S. PATENT DOCUMENTS

| | | | |
|---|---|---|---|
| 2,412,365 | 12/1946 | Sollinger | 415/160 |
| 2,817,475 | 12/1957 | Moody | 415/160 X |
| 3,089,679 | 5/1963 | Henny | 415/160 |
| 3,251,539 | 5/1966 | Wolfe et al. | 415/160 X |
| 3,362,625 | 1/1968 | Endress | 415/149 R |

FOREIGN PATENT DOCUMENTS

| | | | |
|---|---|---|---|
| 1114461 | 4/1956 | France | 415/160 |
| 58-167825 | 10/1983 | Japan | 60/611 |
| 58-167824 | 10/1983 | Japan | 60/611 |
| 58-185934 | 10/1983 | Japan | 60/611 |

*Primary Examiner*—Robert E. Garrett
*Assistant Examiner*—Joseph M. Pitko
*Attorney, Agent, or Firm*—Hill, Van Santen, Steadman & Simpson

[57] ABSTRACT

An axial torque governor for a turbo-supercharger for internal combustion engines has a flow channel which is composed of a cylindrical section and of a spherical section following thereupon, the spherical section merging into a second cylindrical section by way of a nozzle section. The radius of the spherical section is equal to the radius of the first cylindrical section. A plurality of guide vanes are each composed of essentially circular segments which cover the cross-section of the first cylindrical section given complete closure of the inlet passage, whereby the pivoting axes of the guide vanes respectively lie in the entry edge of the vanes.

7 Claims, 2 Drawing Sheets

AXIAL TORQUE GOVERNOR FOR A TURBO-SUPERCHARGER FOR INTERNAL COMBUSTION ENGINES

BACKGROUND OF THE INVENTION

1. Field of the Invention

The present invention is directed to an axial torque governor for a turbo-supercharger for an internal combustion engine comprising a radial compressor composed of an axial diffusor and comprising a collar of guide vanes extending radially relative to the supercharger axis and pivotable around radially-directed swiveling axes, the guide vanes being arranged in a flow channel in a housing whose inner wall, as seen in the flow direction, comprises a first jacket of a cylindrical section and a jacket of a spherical section, and adjustment levels arranged on the shafts of the guide vanes and projecting out along the pivoting axes, the adjustment levers engaging into an adjustment ring which concentrically closes the housing.

2. Description of the Prior Art

Turbo-superchargers are employed in internal combustion engines in order to increase the power and torque given favorable fuel consumption. Since, due to their pressure-volume characteristic, turbo-superchargers comprising a radial flow compressor are not capable of covering the entire operating range of the internal combustion engine, operating conditions which lie to the left of the surge or, respectively, flow-disruption limit of the compressor performance characteristics can occur, first of all, given low engine speed and a full-load operation and, secondly, operating conditions which lie to the right of the tamping limit of the compressor performance characteristics can occur given high engine speeds and full-load operation. For this reason, it is standard to design turbo-superchargers such that the surge or, respectively, flow-disruption limit is not crossed toward the left given lower engine speeds as well as a partial load or, respectively, flow-load operation. For example, the German published application No. 14 26 076 discloses bypass valves at the turbine side for the control of this operating behavior, a portion of the exhaust stream being capable of being conducted around the turbine with assistance of the bypass valves in order to avoid high boost pressures given full load and high speed. A portion of the energy of the exhaust is lost, unused, in this control.

Another control at the turbine side is realized by an adjustable nozzle scroll in accordance with the German published application No. 24 55 361, whereby the exhaust gas can be better utilized.

In general, however at the turbine side for turbo-superchargers only influence the power or, respectively, the torque. They are suitable for adapting a momentary power consumption of the compressor to the requirements within the limits established by the available quantity of exhaust gas and by the temperature of the exhaust gas. They thereby bury the mass flow, but not the compressor performance characteristics. As a consequence thereof, it is definitely possible that the compressor operating point migrates out of the region of good efficiency, or can even end up in the surge region.

The German published application No. 14 26 076 also discloses a turbo-supercharger control at the compressor side, whereby the volume stream can be reduced, in fact can even be entirely suppressed by way of a throttle valve in the suction region. A suppression of the volume flow can be desirable for example, given a temporary disengagement of the engine, for example when disengaging the clutch, in order to provide that the compressor no longer takes any power and the rotor of the turbo-supercharger does not all too greatly decrease in speed. Moreover, a modification of the usable range of performance characteristics is not possible with this turbo-supercharger governor at the compressor site.

The German application No. 16 28 232 discloses an axial torque governor for compressors having larger dimensions with which a shift in characteristics is possible. In this axial torque governor, the flow channel in which the guide vanes of the axial inlet passage are arranged is composed of two cylindrical jacket sections having diameters differing only slightly and on the spherical section lying there between, whereby the radius of the sphere is larger than the radius of the larger cylindrical jacket section, i.e. the flow channel experiences an increase in diameter in the region of the guide vanes. This increase in diameter in the flow channel leads to a burbling and to an increase in the trailing vortex caused by the discontinuity in speed at the guide vanes. Since the cylindrical jacket section following the spherical section at the compressor side has only an insignificantly smaller diameter than the first cylindrical jacket section, a rapid suppression in the disturbance of the flow before entry into the compressor is not possible.

SUMMARY OF THE INVENTION

The object of the present invention is to provide an axial torque governor for a turbo-supercharger with which the performance range of the internal combustion engine can be further expanded given best efficiency or, respectively, favorable fuel consumption. In particular, these optimum operating ranges should be quickly and economically reached at every engine speed given both full load and partial load, i.e. even extreme operating conditions and their sudden changes should be economically covered. The usable range of control must be so broad and compressor performance characteristics should be designed so displaceable that the respective operating point lies in the region of greatest deficiency and the surge limit does not touch the respective operating point due to shift of the performance characteristics.

The above object is achieved, according to the present invention in a turbo-supercharger of the type set forth above which is particularly characterized in that the spherical radius of the spherical section is equal to the radius of the first cylindrical section, in that the spherical section merges nozzle-like into a second cylindrical section having a significantly smaller radius in that the guide vanes are essentially circular elements of such a shape and division that they nearly entirely cover the cross-section of the flow channel given complete closure of the inlet passage, and in that the pivotal axes respectively lie in the leading vane edge of the guide vanes.

What is achieved by the structure proposed by the present invention is that the bi-cylindrical section following the spherical section has a significantly smaller radius following the pivotal guide vanes and, therefore, the reduction and cross-section of the flow channel generates an accelerated jet flow, whereby the wake disturbances of the guide vanes and, in particular the wake depressions caused by the boundary layer effect are quickly suppressed and a healthy, uniform intake flow to the compressor rotor disk is guaranteed.

It can thereby be achieved that the surge limit is shifted towards the left to such a degree, due to a displacement of guide vanes that the quantity of required loading air and the required loading air pressure dependent on the engine load, the fuel consumption and the engine speed are available, even given extreme operating conditions and their sudden changes, whereby the performance characteristic is shifted such that the operating pressure always lies to the right of the surge limit.

According to a feature of the invention, the spherical section in the housing encompasses the entire vane region.

According to another feature of the invention, the transition of the housing jacket from the first cylindrical section to the spherical section lies in the plane of the pivotal axes of the guide vanes.

According to another feature of the invention, the ratio of the diameter of the first cylindrical section to that of the second cylindrical section lies between 1.4 and 1.6 and, preferably, between 1.45 and 1.5.

According to another feature of the invention, the shafts of the pivotal axes of the guide vanes are seated in rollers in the housing and carry the adjustment lever exteriorly of the housing, in that the guide vanes and the rolling bearing and the adjustment lever are braced in a non-positive manner by way of a screw arrangement.

According to another feature of the invention, the free end of the adjustment lever has a ball pivot which is guided in a groove in the adjustment ring parallel to the supercharger axes.

According to another feature of the invention, the adjustment ring is seated on a cylindrical angular surface located on the exterior of the housing concentrically with the supercharger axis.

According to another feature of the invention, the bearing for the adjustment ring is a needle bearing.

According to another feature of the invention, the guide vane adjustment comprises end limits.

According to still another feature of the invention, the outer end of one of the guide vane shafts carries a potentiometer for electrically determining the vane pitch.

Ratios in the diameter of the first cylindrical section to the second cylindrical section are between 1.4 and 1.6, and preferably between 1.45 and 1.5 have proven particularly expedient for the advantageous effect of the invention, whereby the features of the invention offer the possibility of providing optimum operating conditions in the overall range of engine operation, even given turbo-superchargers having very small compressor wheel diameters, as currently employed in motor vehicle construction.

Given the small dimensions of turbo-superchargers currently standard in the motor vehicle field, whereby the first cylindrical jacket section can lie in the range of 60 mm and less, given standard turbo-superchargers, it is particularly important to provide that the unavoidable manufacturing tolerances which have a relatively pronounced effect during assembly given the small, absolute dimensions, do not disturb the operation. The invention therefore provides measures that the inlet passage can be assembled such that a faultless adjustment is possible without seizing and that the fixing on the basis of a non-positive screw-type connection is only carried out subsequently thereto. It is provided, for this purpose, that the shafts of the pivotal axes of the guide vanes are roller-seated in the housing and carry adjusting levers outside of the housing and that the guide vanes, the rolling bearing and the adjustment levers are braced in a non-positive manner. It is further provided that the free end of the adjustment lever carries a ball pivot that is guided in the adjustment ring in a groove parallel to the supercharger axis, whereby the adjustment ring is seated concentrically with the supercharger axis on a cylindrical angular surface on the exterior circumference of the housing.

BRIEF DESCRIPTION OF THE DRAWINGS

Other objects, features and advantages of the invention, its organization, construction and operation will be best understood in the following detailed description, taken in conjunction with the accompanying drawings, on which.

DESCRIPTION OF THE PREFERRED EMBODIMENTS

Figure 1:
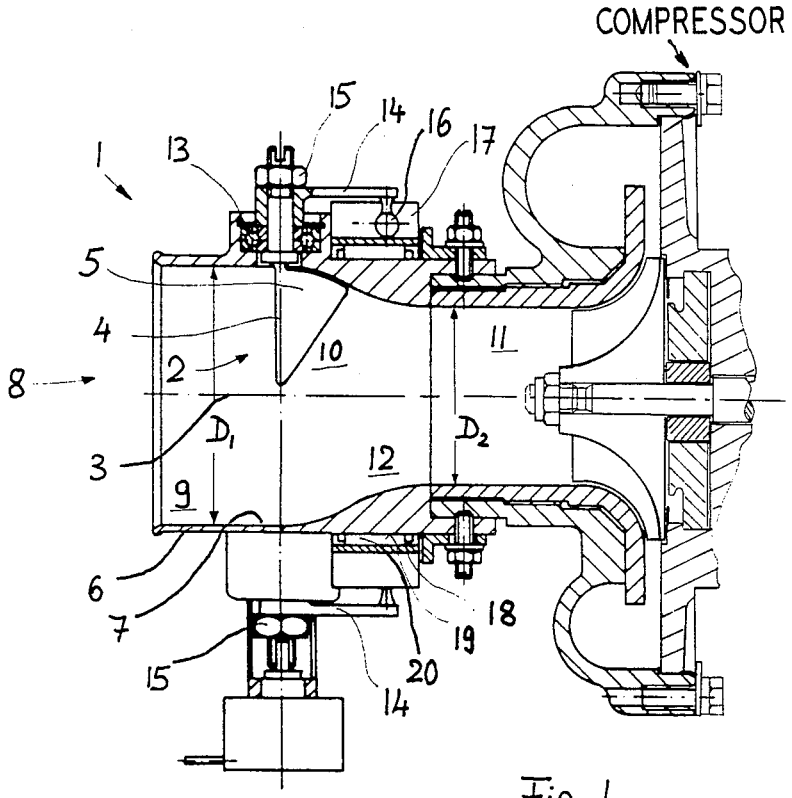
FIG. 1 is a longitudinal sectional view through an axial torque governor mounted at a cover of a compressor housing.

An axial torque governor 1 is illustrated in FIG. 1 as mounted on the spiral housing of a compressor of a turbo-supercharger for internal combustion engines and comprises a housing 6 in whose interior the flow channel extends, a inlet passage diffusor 2 comprising adjustable guide vanes 5 arranged in the flow channel. The flow channel has a first cylindrical section 9 which extends in front of the inlet passage 2 and merges into a spherical section 10 whose spherical radius is equal to the radius of the first cylindrical section 9. The spherical section 10 is followed by a second cylindrical section 11 whose diameter is significantly smaller than that of the first cylindrical section 9 and into which the spherical section merges with a portion fashioned as a nozzle section 12. A diffusor section in which the compressor field rotates follows the second cylindrical section 11.

The inlet passage diffusor 2 comprises a collar of guide vanes 5 which extend over the cross-section of the flow channel and essentially have a circular segment of such a shape and division that the guide vains 5 cover the cross-section of the flow channel nearly entirely given complete closure of the passage 2. Only one guide vane 5 is shown in FIG. 1.

The pivotal axis of the individual guide vanes 5 respectively extend in the leading edge of the vanes, so that the outwardly-projecting shaft of the guide vanes extends in the extension of the leading edge. The spherical section 10 which, as already mentioned, has a spherical radius corresponding to the radius of first cylindrical section 9 begins in the region of the plane of the pivoting axes. The base of the guide vanes likewise extend in the shape of a circular arc comprising a radius corresponding to the spherical radius, so that an unchanging, uniform gap width for all angular positions occurs for all given pivoting positions given pivoting of the guide vanes, and the rear edge of the guide vanes follow the contour of the channel. The shafts of the guide vanes 5 are seated in the housing 6 in a respective rolling bearing 13 and carry a respective adjustment lever 14 at the section located outside of the housing 6, the free ends of the adjustment levers 14 being provided with a respective radially, inwardly-directed ball pivot 16. The respective guide vane 5 and the apertaining rolling bearing, as well as the apertaining adjustment lever 14, are braced relative to one another in a non-positive manner with the assistance of a groove-nut adjustment 15. The rolling bearing 13 is fixed in a bushing attached the exterior of the housing 6. In the region next to the bushing, the housing 6 is provided with a cylindrical annular surface 19 which is concentric to the supercharger axis 3, an adjustment ring 18 being held and seated on the cylindrical annular surface 19 with the assistance of a needle bearing 20. The exterior of the adjustment ring is provided with grooves 17 extending parallel to the supercharger axis, the ball pivot 16 engaging into such groove. By turning the adjustment ring, therefore, the collar of the guide vane can be angularly adjusted in the desired manner via the adjustment levers 14 in order to influence the torque of the flow. Since the absolute dimensions are relatively small as a consequence of the size of the turbo-supercharger and, consequently, the unavoidable tolerances in assembly have a relatively pronounced effect, the respective guide vane, the rolling bearing and the adjustment lever are initially assembled without clamping or, respectively, bracing and the required adjustment positionings are undertaken before the screw-nut arrangement 15 is tightened in order to brace the individual portions in a non-positive manner in the accurately-positioned location. Given the utilization of a positive bracing, an accurate positioning would be extremely difficult due to the unavoidable manufacturing tolerances.

For the sake of an optimum control, even under extreme operating conditions and there sudden changes, it must be seen to that, as already mentioned, wake disturbances (turbulence) at the guide vains are suppressed and compensated as quickly as possible. This occurs by the acceleration of the flow in the region of the nozzle section 12, whereby the desired flow acceleration is achieved by the taper of the cross-section. A Diameter ratio D1/D2 of about 1.4–1.6 has derived as particularly advantageous for the taper. This ratio preferably lies between 1.45 and 1.5, whereby the number of guide vanes can be decisive for differences in the values of the ratio. It has been shown that the desired shift of the performance characteristic for optimizing the engine operation can be achieved with a diffusor composed of 5–14 guide vanes, even given extreme operating conditions.

Figure 2:
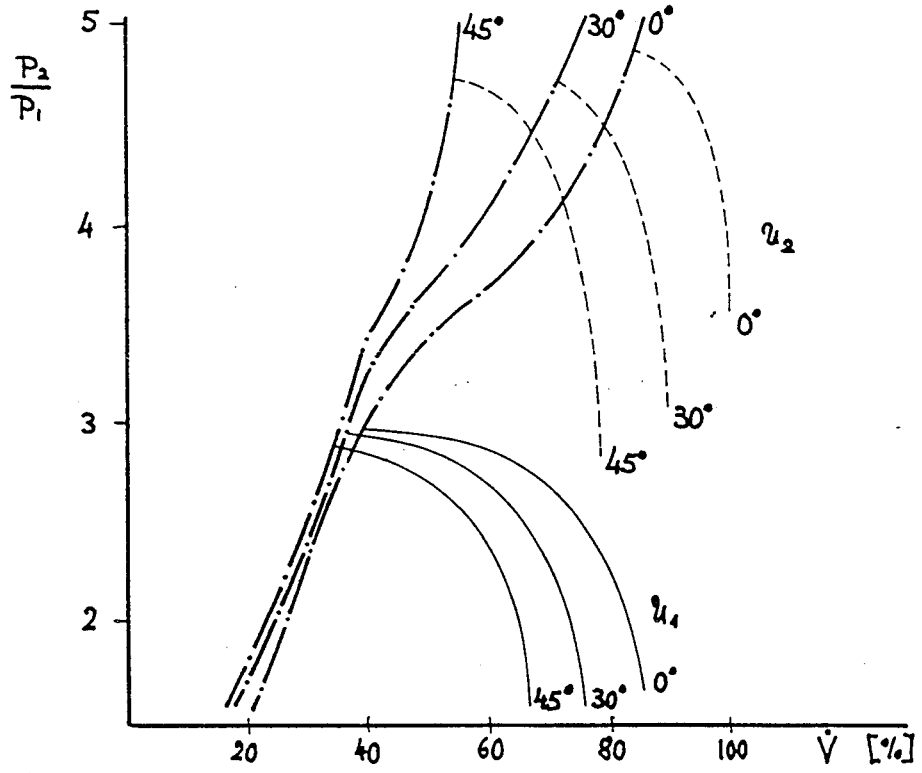
FIG. 2 is a graphical illustration of a performance characteristic from which the shift of the surge limit is shown dependent on the vane position for plurality of circumferential speeds.

FIG. 2 illustrates a performance characteristic wherein the ratio of the pressure at the output side to the pressure at the input side is entered over the volume flow of the input side. The diagram illustrates that a shift of the position of the surge limit (shown with dot-dash lines) toward the left can be achieved given an angular adjustment of the guide vanes 5 with an increasing angle, whereby the operating characteristics are entered for two circumferential speeds. The family of curves shown with solid lines is assigned to the lower circumferential speed and the family of curves shown with broken lines is assigned to the higher circumferential speed. The values of volume flow entered on the abscissa are normalized and entered in percentages, whereby 100% is assigned to the volume flow occurring at the tamping limit.

Although we have described our invention by reference to a particular illustrative embodiment thereof, many changes and modifications thereof may become apparent to those skilled in the art without departing from the spirit and scope of the invention. We therefore intend to include within the patent warranted hereon all such changes and modifications as may reasonably and properly be included within the scope of our contribution to the art.

We claim:

1. An axial torque governor for a turbo-supercharger for internal combustion engines comprising:

a radial compressor;

a housing defining an axial inlet passage, said inlet passage including a collar comprising a plurality of guide vanes extending radially relative to the turbo-supercharger axis and pivotable about radially-directed pivoting axes, said pivoting axes defining a plane;

said inlet passage defining a flow channel including an inner wall, as viewed in the flow direction, comprising a first jacket of a cylindrical section and a second jacket for a spherical section;

said first and second jackets connected and including a transition of said first jacket from said first cylindrical section to said spherical section, said transition lying in the plane of said pivoting axes of said guide vanes;

said spherical section in said housing encompassing the entire vane region;

mounting means mounting said guide vanes through said housing and including a plurality of shafts each connected to a respective one of said guide vanes and projecting out along the respective pivoting axis;

a plurality of adjustment levers each connected to a respective one of said shafts;

an adjustment ring concentrically about said housing and pivotably connected to said adjustment levers;

the spherical radius of said spherical section being equal to the radius of said first cylindrical section;

a second cylindrical section extending from said spherical section and mounted to said radial compressor and including a significantly smaller radius than the radius of said first cylindrical section, the ratio of the diameter of said first cylindrical section to the diameter of said second cylindrical section lying between 1.4 and 1.6;

said spherical section merging nozzle-like into said second cylindrical section;

said guide vanes comprising essentially arcuate elements shaped and dimensioned such that they nearly entirely cover the cross-section of the flow channel upon operation thereof to complete closure of said inlet passage;

said pivoting axes and said shafts connected to respective ones of said guide vanes at the leading edges of said guide vanes; and said guide vanes having respective bases which extend in the shape of a circular arc comprising a radius corresponding to the spherical radius and providing an unchanged uniform gap width for all angular portions with the rear edge of the guide vanes following the contour of the channel defined by said spherical section.

2. The axial torque governor of claim 1, wherein: said ratio lies between 1.4 and 1.5.

3. The axial governor of claim 1, wherein: said ratio lies between 1.45 and 1.5.

4. The axial torque governor of claim 1, and further comprising:

a plurality of roller bearings respectively mounting said shafts of said guide vanes in said housing; and a plurality of screw arrangements non-positively holding respective ones of said adjustment levers to said shafts.

5. The axial torque governor of claim 4, wherein:

each of said adjustment levers comprises a distal end including a ball pivot; and said adjustment ring includes a plurality of grooves each receiving and guiding a respective one of said ball pivots parallel to the axis of said turbo-supercharger.

6. The axial torque governor of claim 5, wherein said housing comprises:

a cylindrical annular surface; and said adjustment ring is seated on said cylindrical annular surface concentrically with the axis of said turbo-supercharger.

7. The axial torque governor of claim 6, and further comprising:

a needle bearing mounting said adjustment ring on said housing.

* * * * *